US008157917B2

(12) United States Patent
Arnold et al.

(10) Patent No.: US 8,157,917 B2
(45) Date of Patent: Apr. 17, 2012

(54) THERMAL CONDUCTION DURING ALKALINE EXTRACTION

(75) Inventors: Jochen Arnold, Obrigheim (DE); Stefan Frenzel, Weinheim (DE); Thomas Michelberger, Grünstadt (DE)

(73) Assignee: Sudzucker Aktiengesellschaft Mannheim/Ochsenfurt (DE)

( * ) Notice: Subject to any disclaimer, the term of this patent is extended or adjusted under 35 U.S.C. 154(b) by 567 days.

(21) Appl. No.: 11/910,656

(22) PCT Filed: Mar. 15, 2006

(86) PCT No.: PCT/EP2006/002344

§ 371 (c)(1),
(2), (4) Date: Oct. 4, 2007

(87) PCT Pub. No.: WO2006/108481

PCT Pub. Date: Oct. 19, 2006

(65) Prior Publication Data

US 2008/0214804 A1 Sep. 4, 2008

(30) Foreign Application Priority Data

Apr. 15, 2005 (DE) ..... 10 2005 017 446

(51) Int. Cl.
*C13B 10/00* (2011.01)

(52) U.S. Cl. ..... 127/43; 536/128

(58) Field of Classification Search ..... 536/128; 127/43

See application file for complete search history.

(56) References Cited

U.S. PATENT DOCUMENTS

| | | | | |
|---|---|---|---|---|
| 5,565,231 | A | 10/1996 | Malone et al. | |
| 5,703,228 | A | 12/1997 | Heidlas et al. | |
| 6,149,957 | A | 11/2000 | Mandralis et al. | 426/387 |
| 6,387,186 | B1 * | 5/2002 | Reisig et al. | 127/55 |
| 2005/0090704 | A1 | 4/2005 | Roettger et al. | |
| 2006/0106210 | A1 | 5/2006 | Frenzel et al. | 536/124 |

FOREIGN PATENT DOCUMENTS

| | | |
|---|---|---|
| DE | 198 37 958 C1 | 3/2000 |
| DE | 102 60 983 | 7/2004 |
| EP | 1 002 879 | 5/2000 |
| EP | 1 473 932 | 11/2004 |
| FR | 2 334 395 | 7/1977 |
| GB | 782652 | 9/1957 |
| JP | 8-502899 | 4/1996 |
| JP | 8-245674 | 9/1996 |
| JP | 2001-354991 | 12/2001 |
| JP | 2002-306075 | 10/2002 |
| JP | 2004-24094 | 1/2004 |
| JP | 2005-527501 | 9/2005 |
| WO | WO 94/16110 | 7/1994 |
| WO | WO 2004/055219 | 7/2004 |

OTHER PUBLICATIONS

Schultheiss et al, IEEE Transactions on Plasma Science, vol. 30, No. 4, Aug. 2002.*

Notification by the European Patent Office dated Dec. 1, 2008 issued in the related EP Patent Application 06 723 421 (3 pages).

A. Kubasiewicz et al., Heat Exchange in the Trough Diffusion Process, FSTA Journal, Publisher Gazeta Cukrownicza, Chemadex, Poland, 1975, pp. 61-64, English language Abstract only (1 page).

English translation of International Preliminary Report on Patentability dated Mar. 15, 2006 in PCT/EP2006/002344.

Schiweck, Hubert "Sugar—Production of Juice (Extraction)", Ullmann's Encyclopedia of Industrial Chemistry, Online Posting Dated Jun. 15, 2000. Copyright 2002 by Wiley-VCH Verlag GmbH & Co. KgaA. pp. 1-10.

PCT International Search Report dated Jun. 29, 2006 issued in corresponding PCT International Patent Appln. PCT/EP2006/002344.

Japanese Office Action mailed Sep. 7, 2010 in corresponding Japanese Patent Application No. 2008-505751.

Japanese Office Action mailed Jan. 11, 2011 in corresponding Japanese Patent Application No. 2008-505751 (English language translation).

P. W. van der Poel, et al., "Sugar Technology, Beet and Cane Sugar Manufacture," pp. 334-337, 339, 344-349 (1998).

* cited by examiner

*Primary Examiner* — Elli Peselev
(74) *Attorney, Agent, or Firm* — Ostrolenk Faber LLP

(57) ABSTRACT

The present invention relates to an improved process for extracting and subsequently isolating components from biological material, in particular sugar beets.

17 Claims, 3 Drawing Sheets

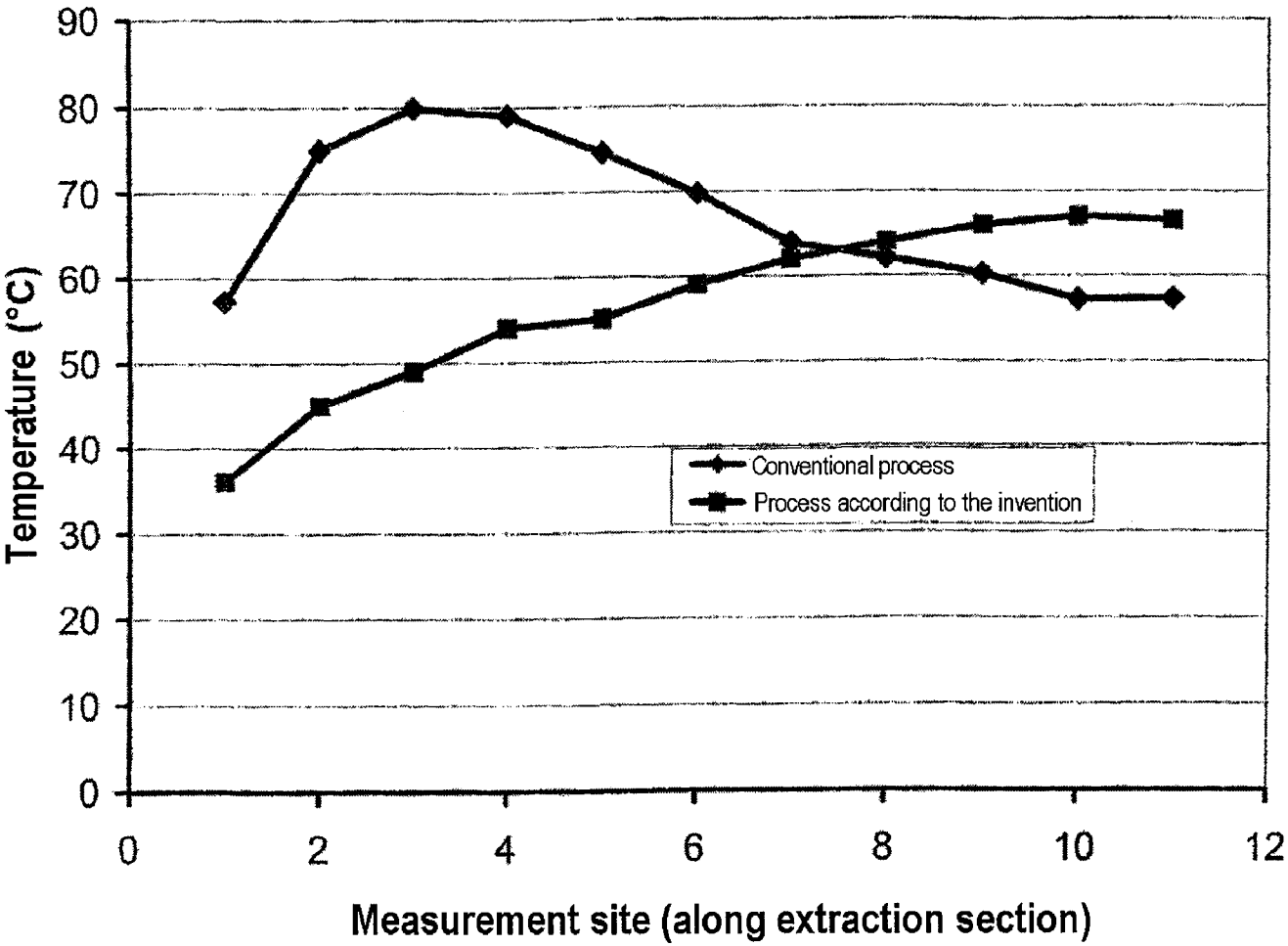
Figure 1: Thermal conduction in the extraction system

Figure 2: Result of the pressing experiments
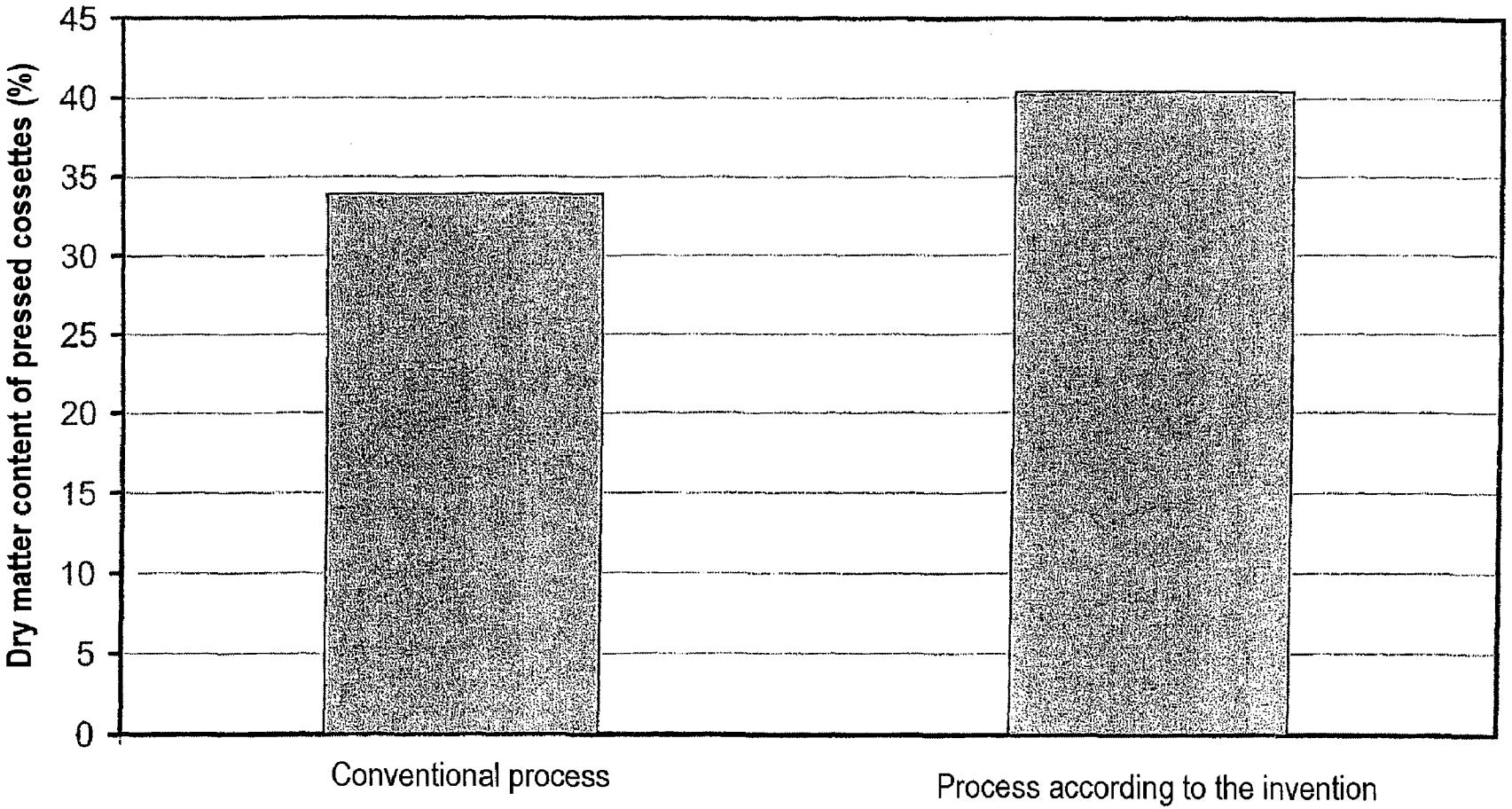

Figure 3: Comparison of the extraction losses
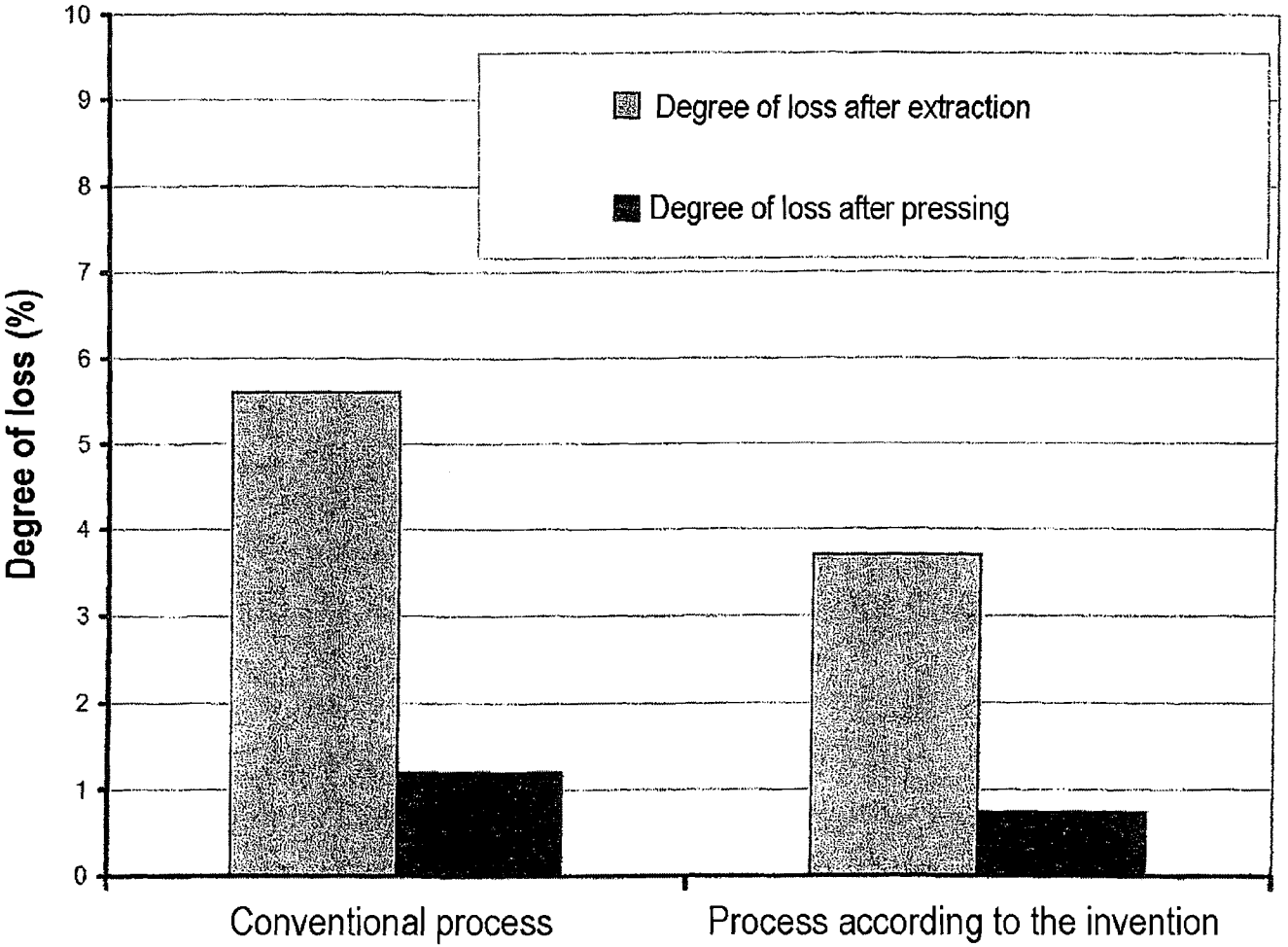

THERMAL CONDUCTION DURING ALKALINE EXTRACTION

CROSS REFERENCE TO RELATED APPLICATION

The present application is a 35 U.S.C. § §371 national phase conversion of PCT/EP2006/002344, filed Mar. 15, 2006, which claims priority of German Patent Application No. 10 2005 017 446.9, filed Apr. 15, 2005, the disclosure of which has been incorporated herein by reference. The PCT International Application was published in the German language.

FIELD OF THE INVENTION

The present invention relates to processes for extracting and isolating components from biological material, in particular sugar beet cossettes or sugar beets.

BACKGROUND OF THE INVENTION

Plants generally contain components, in particular also water-soluble components, such as sucrose, inulin or starch. These components are enclosed in plant cells and are separated by biological membranes which prevent cell juice from being able to exit. As a precursor for the extractive workup of cell material, it is therefore necessary to destroy these membranes so that the cell juice can escape. This, which is termed denaturation, of the plant material is customarily effected by heating the plant material to temperatures above 70° C. As a result the plant material is first heated and this denatured heated plant material is subsequently subjected to an extraction. This proceeds in such a manner that the extraction medium is passed in countercurrent flow to the cossette material, wherein the cossette material gives off the sugar and the extraction medium takes up the sugar. The extraction medium is generally colder than the plant material after the thermal denaturation. As a result, the temperature of the cossette material decreases along the extraction section, that is to say, the cossette material cools successively along the extraction section. According to the known extraction processes, the sugar beets processed into cossettes are heated as rapidly as possible to temperatures above 70° C. and extracted in countercurrent flow with the extraction medium, usually water, for example fresh water or condensate. As a result, a temperature gradient forms along the extraction section, which temperature gradient decreases after heating of the cossettes from the cossette feed up to the cossette discharge.

This procedure requires, however, that the extraction is carried out in a temperature range (65° C. to 75° C.) in which changes in the texture of the cossette framework substance and also chemical changes already occur on the cossette material. The consequence of this is that non-sugar components are extracted from the cossette material and the purity of the extract is decreased. At the same time, as a result of the high temperature, the texture of the cossette material is weakened. This is of importance, since generally the next processing step carried out is mechanical dewatering of the cossette material via, for example, twin-screw presses. The weakening of the cossette structure associated with the temperature stressing of the cossette material impairs the ability of the cossette material to be dewatered.

SUMMARY OF THE INVENTION

The technical problem underlying the present invention is therefore, in particular, to provide a process in which desired components are extracted from biological material, in particular sugar from sugar beets, or preferably sugar beet cossettes, as completely as possible and very selectively, when at the same time a high purity of the extract and an as low as possible impairment of the cossette structure with an inexpensive processing procedure is made possible.

The invention solves this problem by providing a process for extracting components, in particular water-soluble components, for example sugar, from biological material, in particular from sugar beets (*Beta vulgaris*) or sugar beet cossettes, wherein the biological material is exposed in an extraction system to a temperature gradient which increases in the course of time of the extraction, that is to say, that the biological material is heated in the course of the extraction from material feed to material discharge. In particular, the invention therefore provides a process for extracting biological material, in particular sugar beets, preferably sugar beet cossettes, in a sugar beet extraction system, wherein the temperature of the biological material, in particular the sugar beets, or preferably the sugar beet cossettes, is increased in the sugar beet extraction system in the course of the extraction from cossette feed to cossette discharge, that is to say an increasing or inverse temperature gradient is built up along the extraction section or during the extraction.

In the context of the present invention, the biological material is taken to mean any biological material which can be subjected to an extraction by means of an extraction medium for isolating components, in particular water-soluble components. In a particularly preferred embodiment, the biological material is plant material, in particular material such as sugar beets, sugar cane or chicory, and also parts or pieces thereof, in particular sugar beet cossettes. The biological material can also be present in the form of suspensions, likewise in solid form, for example as sugar beet cossettes or as sugar beet cossette-juice mixture, wherein the juice can be a cell juice obtained by pretreatment of the biological material such as slicing, thermal denaturation or electroporation.

In the context of the present invention, an extraction medium is a medium which can serve for extracting components from biological material, for example water, in particular fresh water, or else condensate from a sugar factory.

In the context of the present invention, extraction is taken to mean a separation process for extracting certain components, in particular sugar, from solid or liquid compositions of matter, in particular biological material, using suitable solvents, wherein no chemical reactions take place between the solvent and the dissolved substance, that is to say the component of the biological material. In the isolation of water-soluble components from biological material, as mentioned, preferably use is made of water in liquid phase as extraction medium, for example in the isolation of sugar from sugar beets, or sugar beet cossettes. In a variant, in addition, or exclusively, fat-soluble components can be isolated from the biological material using predominantly nonpolar and/or organic solvents.

The present invention therefore provides feeding to an extraction process the biological material to be extracted if appropriate after pretreatment, for example slicing and/or electroporation and/or thermal denaturation, at a defined starting temperature, and wherein this starting temperature is increased in the course of time of the extraction from the start to the end. The invention provides that the temperature of the biological material is increased during the extraction, or seen spatially, along the extraction section, preferably by at least 10° C., at least 15° C., at least 20° C., at least 25° C., or more preferably at least 30° C. This can be achieved in a particularly preferred embodiment by the extraction medium being fed to the extraction process, and therefore to the biological material to be extracted, in a warmer form than the biological material. Preferably, the extraction medium is fed to the biological material in the counter flow principle, in such a manner that the fresh extraction medium first encounters the biological material already situated at the end of the extraction section, there leads to a warming of the extraction material, and in the course of the further extraction, heat is given off to the biological material in an increasingly decreasing extent up to the start of the extraction section. This produces an advantageous reversal of the temperature profile with an increasing temperature of the biological material along the extraction section. This procedure, in addition, has the advantage that the counter flow principle applies not only to the material streams, but also to the heat streams conducted in countercurrent flow. This enables a decrease in the heat requirement of the extraction system. In a particularly preferred embodiment it is provided that the extraction medium, on entry into the extraction, that is to say preferably on entry into the end region of the extraction, has a temperature of 40 to 100° C., preferably 50 to 80° C., wherein the temperature of the extraction medium is reduced in the course of the further extraction, which preferably takes place in the countercurrent flow process, by giving off heat to the extraction material, that is to say the biological material is reduced, and wherein, conversely, the biological material is heated in the context of the extraction.

The procedure according to the invention leads to an improved dewaterability of the sugar beet tissue, to an increase in the extraction yield, and to an increase in the purity of the extract, in particular by the gentle treatment of the biological material, in particular sugar beet tissue, provided in the context of the inverse temperature gradient, and owing to the more efficient cell disintegration. The increased temperature at the end of the extraction process makes it possible to be able to extract even the last sugar residues, wherein at the same time a high pressability of the cossettes and low sugar losses are ensured.

Preferably, the invention provides that the temperature of the biological material, in particular the sugar beet cossettes, is, at the start of the extraction, that is to say at the material feed, in particular cossette feed, from 0° C. to 40° C., preferably 25° C. to 36° C. The temperature rises in the course of the extraction from the material feed, in particular cossette feed, to the material discharge, in particular cossette discharge, from the extraction system, and more precisely preferably to a temperature of 40 to 80° C. In a particularly preferred embodiment it is provided that the temperature of the biological material, in particular of the sugar beet cossettes on material discharge, in particular cossette discharge, from the extraction system has a temperature of 40 to 60° C., preferably 45 to 55° C. In a further preferred embodiment, particularly advantageously, it is provided that the temperature of the biological material, in particular of the sugar beet cossettes on material discharge, in particular cossette discharge, from the extraction system has a temperature of 60 to 80° C., preferably 65 to 75° C.

In a further preferred embodiment it is provided that the biological material used is used in comminuted form, for example in the form of sugar beet cossettes which, as explained, in a preferred embodiment have been electroporated. It can also be provided that the biological material to be used for the extraction according to the invention was thermally disintegrated prior to the extraction. In a further preferred embodiment, it is provided that aids, in particular lime and/or milk of lime, are added to the biological material used, in particular to the electroporated sugar beet cossettes.

In a further particularly preferred embodiment, it is provided that the extraction carried out is an alkaline extraction. Accordingly, in a preferred manner, the biological material is extracted at a pH of approximately 7 to approximately 14.

In a preferred variant, the extraction takes place as alkaline extraction, in particular using alkalizing agents such as milk of lime and/or burnt lime. "Alkaline" is taken to mean in this context the pH of an aqueous medium of approximately pH 7 to approximately pH 14 (at 20° C.). In a preferred variant, the alkaline extraction is carried out at pH 7.5 to pH 12, in particular at approximately pH 11, for example pH 11.5.

In an alkaline extraction, unwanted chemical reactions with the biological material cannot be excluded in all cases, in particular a proportion of soluble high-molecular-weight calcium pectate can be formed. Customarily, these unwanted chemical reactions can be reduced by the alkalizing of the plant material being carried out in the form of a pretreatment with milk of lime or calcium saccharate solution at relatively low temperatures (below 20° C.). At known extraction temperatures of approximately 70 to 75° C., nevertheless unwanted chemical reactions of the alkaline extraction occur, such that calcium pectate is formed in part, which makes filtration of the carbonatation juice preferably isolated in the course of a milk of lime-carbon dioxide juice purification much more difficult. In contrast, the alkaline extraction preferred according to the invention which is carried out at low temperatures decreases the formation of these high-molecular-weight compounds, as a result of which, in the filtration of the carbonatation juice, in particular of the 1st carbonatation juice obtained by juice purification in sugar beet extraction, a filtration coefficient of less than 1 $cm^2$/sec is achieved.

Alkalinity is introduced into the biological material, for example in the form of milk of lime, calcium hydroxide, calcium saccharate or burnt lime, for example, preferably, as soon as immediately before or after the electroporation which can take place, in particular in an intermediate bunker before the further processing of the biological material, or even before the electroporation. In a further variant, the alkalinity is introduced immediately before carrying out the extraction. Preferably, according to the invention, the alkalinity is usually introduced into the biological material in the form of aqueous solutions, preferably by spraying. In a further variant, for the purpose of introducing the alkalinity into the biological material, at least one alkaline substance, in particular lime, such as burnt lime, is introduced into the process as solid, preferably in powder form.

By introducing the alkalinity into the biological material, a reduction of the risk of infection of the biological material and the increase in the microbiological stability of the biological material and of the cell juice separated during processing is achieved. The microbiological stability in this case is customarily approximately $10^4$ CFU/ml.

Preferably according to the invention, the extractor used according to the invention is a tower extractor. In a variant, the extractor is a twin-screw extractor, such as a DDS extractor. In a further variant, the extractor is a drum cell extractor, such as an RT drum.

To a particular extent, therefore, the process of the invention is suitable for the alkaline extraction of plant material. In this case the cossettes, in a preferred embodiment of the invention, are pretreated before the extraction in the cold, at temperatures below 20° C., with lime or milk of lime, that is to say alkaline calcium hydroxide solution, or calcium saccharate solution. The pretreatment at temperatures below 20° C. stabilizes the sugar beet pectin (framework substance) and makes possible subsequent extraction at higher temperatures. This pretreatment also increases the uptake capacity of the framework substance for calcium ions and the dewaterability of the cossettes is significantly increased thereby. In addition, a protection against microbial metabolism of the sugar is achieved.

In a particularly preferred form of the present invention, it is provided that the biological material to be used for the electroporation, before the extraction to be carried out according to the invention, has been subjected to an electroporation, that is to say has been exposed to a high-voltage field in a conductive medium. It can be provided that the high-voltage field is generated in a manner known per se, for example via voltage-conducting electrodes by applying a voltage, in particular a high voltage, across the biological material.

Use could also be made of pulsed high-voltage courses, but periodic alternating current fields and direct current fields are also provided. The field strength is, for example, abut 0.1 to 20 kV/cm, in particular 1 to 5 kV/cm, preferably 2 to 4 kV/cm. In a variant, the conductivity of the medium in which the biological material is situated in the electroporation is matched to the conductivity of the biological material in such a manner that an optimum field line course within the biological material is achieved, preferably the conductivity is approximately 0.2 to 10 mS/cm, in particular 0.2 to 2.1 mS/cm, or 2.6 to 6.0 mS/cm. In a particularly preferred variant, for the electroporation, use is made of whole fruits, for example whole sugar beets, in order, if appropriate, to comminute this material after the electroporation. Of course, in a preferred embodiment, it is also provided to feed the biological material to the electroporation in comminuted form also, for example in the case of sugar beet, in the form of sugar beet cossettes.

In another embodiment it is provided that, from the biological material extracted according to the invention, that is to say, for example, from the cossette-juice mixture resulting after the extraction of the cossettes, components are purified and isolated in a manner which is conventional per se. Preferably according to the invention, the sugar is isolated in the further process in a multistage crystallization system from the extract obtained from the extraction of sugar beets treated according to the invention. The extracted biological material, in particular the extracted sugar beet cossettes, are subsequently further mechanically dewatered and mixed, for example with molasses, and preferably marketed after thermal drying as feed, in particular as feed pellets.

In a further preferred variant, in the process according to the invention, before or after the extraction, at least one aid is fed to the biological material. In the context of the present invention, an "aid" is taken to mean a composition or pure chemical substance which possesses no function in the component produced, preferably the food produced. These are operating materials such as condensate, but also process water, solvents, disinfectants such as formaldehyde, or antifoam agents. Preferably, these are also flocculation aids such as cationic or anionic flocculation aids, substances for introducing alkalinity and/or calcium ions such as milk of lime, burnt lime, calcium hydroxide, calcium saccharate, calcium sulfate and other calcium salts and/or aluminum salts. The at least one aid preferably supplied according to the invention is usually introduced into the biological material, preferably sprayed onto the biological material, in the form of a solution. In a further variant, the at least one aid is introduced as solid, preferably in powder form. The aids introduced also effect a prepurification of the cell juice which is separated off.

The present invention preferably also relates to a process for increasing the pressability of extracted biological material, in particular of sugar beet cossettes, and thereby the dry matter proportion achievable in pressing, characterized in that, in a first step, an electroporation of the biological material, in particular sugar beets, or sugar beet cossettes, is carried out, and in a further step an alkaline extraction, according to the invention, of the electroporated biological material with inverse or rising temperature gradient, in particular of electroporated sugar beets or sugar beet cossettes, is carried out, and subsequently extracted biological material having increased pressability is obtained.

The present invention also further preferably relates to a process for obtaining extracted biological material, in particular extracted sugar beet cossettes, having a high dry matter proportion, preferably of approximately 38% DM, preferably about 40 to 42%, characterized in that, in a first step, the biological material, in particular sugar beets or sugar beet cossettes, is electroporated, in a further step the electroporated biological material, in particular electroporated sugar beets, or sugar beet cossettes, is extracted according to the invention under alkaline conditions with increasing or inverse temperature gradient, in a subsequent step the electroporated biological material, in particular electroporated sugar beets or sugar beet cossettes, is pressed, preferably in a manner known per se, and subsequently extracted biological material having an increased dry matter content is obtained.

Further advantageous designs result from the subclaims.

The invention will be described in more detail with reference to the following example and the accompanying figures.

BRIEF DESCRIPTION OF DRAWINGS

In the figures:

FIG. 1 shows a graphical plot of the thermal conduction in the extraction system in a design according to the invention and in a conventional design, FIG. 2 shows a graphical plot of the results of pressing experiments using differently treated extracted cossettes and FIG. 3 shows a graphical plot of the extraction losses and pressing losses for differently treated cossettes.

DESCRIPTION OF PREFERRED EMBODIMENTS OF THE INVENTION

EXAMPLE

In the context of pilot-plant experiments (processing approximately 1 t of sugar beets), the procedure according to the invention and the known procedure were tested. The test system comprised a pilot-plant electroporation system (throughput: 10 t/h), a pilot-plant cutting tool in order to comminute the sugar beets to give cossettes, a steam-heatable trough worm extraction system (DDS type) and a twin-screw press.

Conventional Process (Alkaline Extraction)

First the sugar beets were sprayed with alkalizing agent and comminuted in the pilot-plant cutting tool. The alkalization expediently proceeded in the cutting tool. Spraying the sugar beets in the cutting tool achieved a satisfactory distribution of the calcium hydroxide solution on the cossette material to be treated. In this process, attention was paid to the fact that this process step was carried out in the cold in a temperature range below 20° C. in order that unwanted side reactions (formation of soluble calcium pectate) were avoided. The alkalized sugar beet cossettes were transferred to the twin-worm extractor. The alkalized sugar beet cossettes were thereafter extracted in the twin-worm extractor for a period of two hours. In this case the desired temperature course was set via the heating of the sections of the heating jacket (see FIG. 1). The temperature course in the extraction system was as follows along the 11 measuring sites from material feed to material discharge (temperature of the biological material): 57.2/75/79.9/79/74.6/69.8/63.9/62.1/60.2/57.1/57.2

The alkaline cossettes were added to the trough extractor at measuring site 1 and the extraction medium (condensate) was added at measuring site 10 (measuring site 11: dripping zone).

In this case the sugar beet cossettes were first scalded along the extraction section (measuring point 1 to 4) in order to effect thermal denaturation and opening of the cell membranes (measuring site 1 to 4). Thereafter the actual extraction followed in which the extraction temperature was slightly reduced again (measuring site 5 to 11).

Process According to the Invention

Approximately 1 t of sugar beets were treated with electric pulses in the pilot-plant electroporation system (throughput approximately 10 t/h) (cell opening by electroplasmolysis). Thereafter the sugar beets were sprayed with alkalizing agent and comminuted in the cold in the pilot-plant cutting tool.

Thereafter the sugar beet cossettes were transferred to the pilot-plant extraction apparatus and extracted over the course of 2 hours. In this process the temperature course in the extractor was set solely via the heating of the fresh extraction water to a defined temperature (in the present case 70° C.) and the countercurrent flow of extraction material (cossettes) and extraction medium (fresh water) (see FIG. 1). The temperature course in the extraction system was as follows along the 11 measurement sites (temperature of the biological material):

36/45/49/54/55/59/62/64/66/67/66.5

Indirect heating of the extractor via the heating jacket heat exchanger was avoided completely.

Results and General Conclusions

The investigation results show that the extracted cossettes (dry matter content of the pressed cossettes in %: 40.4) produced by the process according to the invention were significantly more dewaterable than the extracted cossettes produced by the conventional process (dry matter content of the pressed cossettes in %:33.9) (FIG. 2). In the process according to the invention, the cossette texture was obviously better retained. In particular, in the alkaline extraction, owing to the low initial temperatures in the first region of the extraction in which the active alkalinity is still very high, a gentler treatment of the cossette material is achieved which, in the experiment, caused a significant increase in the dewaterability of the extracted cossettes.

The process according to the invention also gave a better extraction result in the experiment (FIG. 3). Those which are termed the degrees of loss of the extracted cossettes and of the pressed cossettes are shown. The degree of loss after extraction, with the conventional process, was 5.6%, and with the process according to the invention, 3.7%. The degree of loss after pressing was 1.2% with the conventional process and 0.74% with the process according to the invention. The degree of loss after extraction denotes the mass fraction of sucrose in the material to be extracted which is not extracted and therefore remains in the extracted cossettes, and the degree of loss after pressing denotes the mass fraction of sucrose in the material to be extracted which remains in the pressed cossettes. In the case of the process according to the invention, at comparable extraction and pressing conditions, lower degrees of loss were achieved.

The improvement in extraction yield compared with the conventional process is surprising to the extent that it was previously assumed that owing to the lower mean extraction temperature, the driving force for mass transfer and thus the extraction yield falls. Customarily, it is assumed that the critical operation in the extraction is diffusion of the sucrose molecules from the plant cell. The diffusion coefficient of sucrose in aqueous solutions is significantly temperature-dependent. In the process according to the invention, however, it was found that despite the lowering of the mean extraction temperature, better extraction results were achieved. This can possibly be connected with the fact that, owing to the cell opening by electroplasmolysis at the start of the extraction process, convective transport processes play a role, that the cell juice flows out which is made possible even at low temperatures by the cell opening by electroporation and the active pressure in the cell interior (turgor pressure), without the texture of the cossettes being impaired. At the end of the extraction process, diffusion processes clearly play a role in the extraction of the last sugar residues. This process is clearly promoted by high temperatures.

Accordingly, from this concrete example, it also makes sense generally, in the extraction of electroporated plant material at overall really low temperatures, for example a temperature range from 0° C. to 50° C., to set an inverse temperature gradient. By elevating the extraction temperature at the end of the extraction, the last sugar residues can be extracted more effectively and under more gentle conditions than is the case in the conventional process. Carrying out the extraction at such low temperatures is only expedient when especially the gentlest possible treatment of the plant material is sought and less value is placed on a sugar yield which is as complete as possible. However, if an extraction yield as high as possible is sought, the final temperature of the extraction should be elevated to approximately 70° C.

The invention claimed is:

1. A process for extracting biological material, selected from sugar beet, chicory and sugar cane from sugar beet cossettes or sugar beets in an extraction system, wherein the extraction is carried out with use of an extraction medium and the temperature of the biological material is gradually increased in the course of the extraction from material feed to material discharge such that the temperature of the biological material does not decrease during the course of said extraction.

2. The process as claimed in claim 1, wherein the temperature of the biological material at the material feed is in a range from 0° C. to 40° C.

3. The process as claimed in claim 1, wherein the temperature of the biological material at the material feed is in a range from 25 to 36° C.

4. The process as claimed in claim 1, wherein the temperature of the biological material at the material discharge is in a range from 40 to 80° C.

5. The process as claimed in claim 1, wherein the temperature of the biological material at the material discharge is in a range from 60 to 90° C.

6. The process as claimed in claim 1, wherein the temperature of the biological material at the material discharge is in a range from 65 to 75° C.

7. The process as claimed in claim 1, wherein the temperature of the biological material at the material discharge is in a range from 40 to 60° C.

8. The process as claimed in claim 1, wherein the temperature of the biological material at the material discharge is in a range from 45 to 55° C.

9. The process as claimed in claim 1, wherein the biological material, before extraction, has been subjected to an electroporation.

10. The process as claimed in claim 1, wherein, before the extraction, an aid is fed to the biological material, wherein the aid is at least one selected from the group consisting of lime, milk of lime and a calcium saccharate solution.

11. The process as claimed in claim 10, wherein the treatment with lime, milk of lime or calcium saccharate solution takes place below 20° C.

12. The process as claimed in claim 1, wherein the extraction is an alkaline extraction.

13. The process as claimed in claim 1, wherein the temperature of the biological material during the extraction is gradually increased via the extraction medium.

14. The process as claimed in claim 1, wherein the extraction medium, at the start of the extraction, has a temperature of 50 to 80° C.

15. The process as claimed in claim 1, wherein the extraction medium is water.

16. A process for increasing the pressability of extracted biological material wherein the biological material is subjected to an electroporation and subsequently to an extraction according to claim 1.

17. The process as claimed in claim 13, wherein the temperature of the biological material during the extraction is gradually increased via the extraction medium in a countercurrent flow process.

* * * * *